US008767998B2

(12) United States Patent
Imamura et al.

(10) Patent No.: US 8,767,998 B2
(45) Date of Patent: Jul. 1, 2014

(54) PRESSURE ADJUSTOR AND METHOD OF MANUFACTURING THE SAME, SPEAKER DEVICE USING THE PRESSURE ADJUSTOR, ELECTRONIC DEVICE, AND VEHICLE

(75) Inventors: Keisuke Imamura, Osaka (JP); Yukihiro Shimasaki, Hyogo (JP); Kiyoshi Ohashi, Osaka (JP); Yoshimichi Kajihara, Mie (JP); Yohei Jin, Mie (JP)

(73) Assignee: Panasonic Corporation, Osaka (JP)

( * ) Notice: Subject to any disclaimer, the term of this patent is extended or adjusted under 35 U.S.C. 154(b) by 58 days.

(21) Appl. No.: 13/148,796

(22) PCT Filed: Feb. 19, 2010

(86) PCT No.: PCT/JP2010/001072

§ 371 (c)(1),
(2), (4) Date: Aug. 10, 2011

(87) PCT Pub. No.: WO2010/095449

PCT Pub. Date: Aug. 26, 2010

(65) Prior Publication Data

US 2012/0027243 A1 Feb. 2, 2012

(30) Foreign Application Priority Data

Feb. 23, 2009 (JP) ..... 2009-038887

(51) Int. Cl.
*H04R 25/00* (2006.01)

(52) U.S. Cl.
USPC ..... 381/386; 381/349

(58) Field of Classification Search
USPC ..... 381/386, 346, 349, 86, 302, 353–354; 181/89, 151, 148, 149
See application file for complete search history.

(56) References Cited

U.S. PATENT DOCUMENTS

| | | | | |
|---|---|---|---|---|
| 4,657,108 | A | 4/1987 | Ward | |
| 4,855,093 | A * | 8/1989 | Yoshida | 264/29.6 |
| 4,975,318 | A * | 12/1990 | Suda | 442/76 |
| 5,080,743 | A * | 1/1992 | Odajima | 156/243 |
| 5,096,633 | A * | 3/1992 | Yoshida | 264/29.6 |
| 5,458,958 | A * | 10/1995 | Kanzaki et al. | 442/338 |
| 6,589,643 | B2 * | 7/2003 | Okada et al. | 428/297.4 |
| 7,743,877 | B2 * | 6/2010 | Saiki et al. | 181/151 |
| 7,837,009 | B2 * | 11/2010 | Gross et al. | 181/290 |
| 7,878,301 | B2 * | 2/2011 | Gross et al. | 181/290 |
| 7,918,313 | B2 * | 4/2011 | Gross et al. | 181/294 |
| 7,991,181 | B2 * | 8/2011 | Saiki et al. | 381/386 |
| 8,184,826 | B2 * | 5/2012 | Matsumura et al. | 381/89 |
| 2007/0195982 | A1 | 8/2007 | Saiki et al. | |
| 2008/0121461 | A1 * | 5/2008 | Gross et al. | 181/286 |

(Continued)

FOREIGN PATENT DOCUMENTS

| | | |
|---|---|---|
| EP | 2 073 569 A1 | 6/2009 |
| JP | 46-21002 | 6/1971 |

(Continued)

OTHER PUBLICATIONS

International Search Report for PCT/JP2010/001072, May 25, 2010.

*Primary Examiner* — Davetta W Goins
*Assistant Examiner* — Phylesha Dabney
(74) *Attorney, Agent, or Firm* — RatnerPrestia

(57) ABSTRACT

A pressure adjustor includes a sheet-like supporter formed of unwoven fabric or woven fabric, a plurality of activated carbon powder particles attached to the supporter, and binders binding the plurality of activated carbon powder particles to each other. If this pressure adjustor is disposed inside a cabinet of a speaker device including a speaker unit provided in the cabinet, a speaker device is obtained which has an excellent bass reproduction effect even if the device is made small.

11 Claims, 6 Drawing Sheets

(56) References Cited

U.S. PATENT DOCUMENTS

| | | | | |
|---|---|---|---|---|
| 2008/0170737 | A1* | 7/2008 | Saiki et al. | 381/346 |
| 2009/0120715 | A1* | 5/2009 | Saiki | 181/151 |
| 2009/0245562 | A1 | 10/2009 | Saiki et al. | |

FOREIGN PATENT DOCUMENTS

| | | | |
|---|---|---|---|
| JP | 60-500645 | A | 5/1985 |
| JP | 09-285531 | A | 11/1997 |
| JP | 09-308679 | A | 12/1997 |
| JP | 10-99421 | A | 4/1998 |
| JP | 10-099421 | A | 4/1998 |
| JP | 2000-246827 | A | 9/2000 |
| JP | 2000-246827 | A | 9/2000 |
| JP | 2007-153684 | A | 6/2007 |
| JP | 2007-153684 | A | 6/2007 |
| WO | WO 2006/035564 | A1 | 4/2006 |
| WO | WO 2007/116859 | A1 | 10/2007 |
| WO | WO 2009/014015 | A1 | 1/2009 |

* cited by examiner

PRESSURE ADJUSTOR AND METHOD OF MANUFACTURING THE SAME, SPEAKER DEVICE USING THE PRESSURE ADJUSTOR, ELECTRONIC DEVICE, AND VEHICLE

This application is a U.S. National Phase Application of PCT International Application PCT/JP2010/001072.

TECHNICAL FIELD

The present invention relates to a pressure adjustor, a speaker device which uses the pressure adjustor and is used for various types of acoustic devices and information communication devices, an electronic device, and a vehicle. More specifically, the invention relates to a speaker device which realizes bass reproduction with a small speaker cabinet by means of the pressure adjustor, and to a method of manufacturing the pressure adjustor.

BACKGROUND ART

The recent market trend of the audio industry requires high quality reproduction in response to the prevalence of digital audio devices represented by DVD.

Meanwhile, in terms of the environment around houses and vehicles, there is a strong demand to save space and energy.

As a speaker device that can satisfy the above demand, a speaker device which is small and excellent in deep-bass reproduction is required to be developed.

However, if a speaker cabinet of the speaker device is made small, it is difficult to reproduce bass due to the influence of the acoustic stiffness that the speaker cabinet exhibits.

FIG. 8 is a view illustrating a conventional speaker device. The conventional speaker device includes cabinet 101, speaker unit 102 provided in cabinet 101, and pressure adjustor 103 disposed inside cabinet 101.

In the conventional technique, in order to reliably reproduce bass even with a small speaker device and to solve a problem of limitation in bass reproduction which is determined by the cabinet volume, pressure adjustor 103 represented by activated carbon or the like is disposed inside cabinet 101.

Next, the operation of the speaker device will be described. When an electric signal is applied to speaker unit 102, the internal pressure of cabinet 101 changes, so the internal pressure of the cabinet in which pressure adjustor 103 is disposed changes. Air molecules are adsorbed onto pressure adjustor 103 or emitted due to the pressure change, whereby the internal pressure change of cabinet 101 is suppressed.

In this manner, for the conventional speaker device, cabinet 101 operates as a cabinet consistently retaining a large volume. Accordingly, even if the cabinet is compact, it is possible to perform bass reproduction as if speaker unit 102 is mounted on a large cabinet.

That is, pressure adjustor 103 such as activated carbon disposed inside cabinet 101 of the conventional speaker device exhibits an excellent bass reproduction function depending on the contact area thereof with air.

However, in order to satisfy a required minimum level of bass reproduction function, pressure adjustor 103 needs to have a contact area with air to meet the requirement. That is, in order to secure a sufficient contact area with air, a certain amount of pressure adjustor 103 needs to be disposed inside cabinet 101.

Meanwhile, recently, the thinning of flat screen TVs has accelerated, and as a result, the space in which pressure adjustor 103 can be disposed is getting smaller.

As a countermeasure for this, for example, a method is considered in which the activated carbon used as pressure adjustor 103 is made into fine powder to enlarge a specific surface area of the activated carbon.

This method aims to reduce the volume of the activated carbon in cabinet 101 by reducing the necessary weight of the activated carbon while securing the bass reproduction function by increasing the contact area per unit weight of the activated carbon with air.

Generally, the conventional speaker device employs a configuration in which the activated carbon is put in a bag formed of unwoven fabric or the like to fix the position of the activated carbon. Consequently, the above solution has a problem in that the powdered activated carbon leaks from gaps of the bag to the inside of cabinet 101.

The invention solves the problem and provides a pressure adjustor which acts effectively even in space saving. The invention also provides a speaker device which exhibits an improved bass reproduction function using the pressure adjustor.

As information regarding documents of prior art relating to the invention of the present application, for example, Patent Literature 1 is known.

CITATION LIST

Patent Literature

[PTL 1] PCT Japanese Translation Patent Publication No. S60-500645

DISCLOSURE OF THE INVENTION

A pressure adjustor includes a sheet-like supporter formed of unwoven fabric or woven fabric, a plurality of activated carbon powder particles attached to the supporter, and binders binding the plurality of powder particles to each other.

A speaker device includes a cabinet, a speaker unit provided in the cabinet, and the pressure adjustor disposed inside the cabinet.

With this configuration, it is possible to improve the bass reproduction function even if the speaker is made small.

PREFERRED EMBODIMENTS FOR CARRYING OUT THE INVENTION

Embodiment 1

Hereinafter, the configuration of an activated carbon sheet which is a pressure adjustor and a speaker device of Embodiment 1 will be described with reference to FIGS. 1 and 2.

Figure 1:
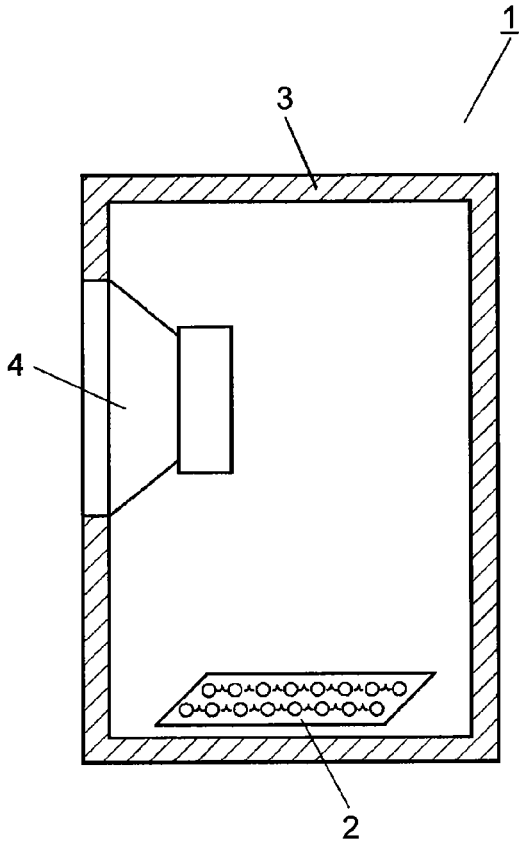
FIG. 1 is a view illustrating a speaker device according to Embodiment 1 of the invention.

FIG. 1 is a view illustrating a speaker device according to Embodiment 1 of the invention. FIG. 2 is a schematic view of an activated carbon sheet according to Embodiment 1 of the invention.

As shown in FIG. 1, speaker device 1 has a configuration in which activated carbon sheet 2 is disposed inside cabinet 3, and speaker unit 4 is provided in cabinet 3. In Embodiment 1, in the configuration shown in FIG. 1, activated carbon sheet 2 is disposed in the bottom surface portion of cabinet 3; however, for example, a configuration may be used in which activated carbon sheet 2 is disposed in the lateral or top surface of cabinet 3.

Figure 2:
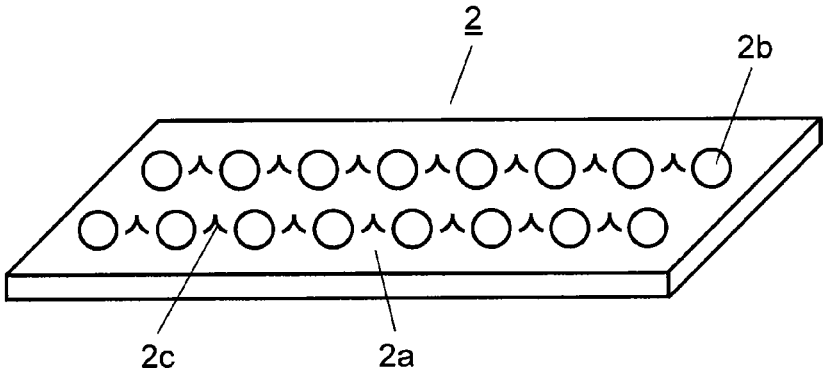
FIG. 2 is a schematic view of an activated carbon sheet according to Embodiment 1 of the invention.

As shown in FIG. 2, activated carbon sheet 2 is formed in a manner in which particle-like activated carbon powder 2*b* and binder 2*c* are attached to supporter 2*a* that can be impregnated with liquid. Herein, binder 2*c* is shown in the drawing for convenience of description, but, for example, when only a water-soluble aqueous binder is used as binder 2*c*, binder 2*c* cannot be visually recognized.

Since speaker device 1 of Embodiment 1 uses activated carbon sheet 2, it is not necessary to make a large space for disposing a pressure adjustor improving the bass reproduction function as the past. That is, only a very small space is needed for disposing activated carbon sheet 2 as the pressure adjustor inside cabinet 3. However, even if the conventional pressure adjustor is made smaller, the speaker device exhibits a bass reproduction function that is equivalent to or better than that of the conventional one.

Hereinafter, a method of manufacturing activated carbon sheet 2 of Embodiment 1 will be described using FIG. 3.

Figure 3:
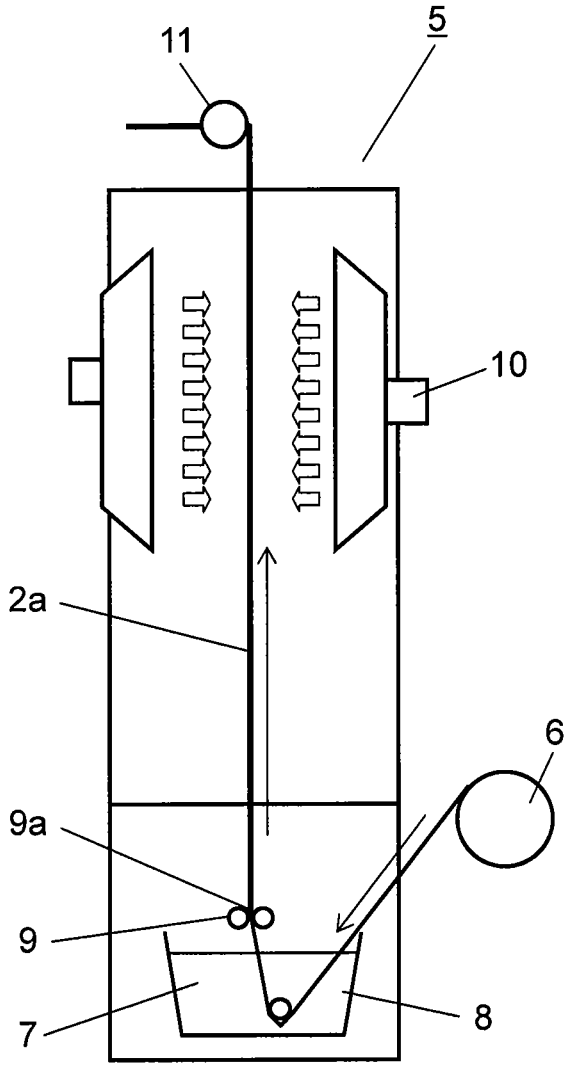
FIG. 3 is a view illustrating an impregnation coating device according to Embodiment 1 of the invention.

FIG. 3 is a view illustrating an impregnation coating device of Embodiment 1 of the invention. Activated carbon sheet 2 which is a pressure adjustor is manufactured using impregnation coating device 5.

First, supporter 2*a* is unwound from unwinding portion 6 of impregnation coating device 5. The unwinding speed of impregnation coating device 5 of the present embodiment is set to 10 cm/min.

Supporter 2*a* having been unwound from unwinding portion 6 is immersed into slurry pan 8 filled with slurry 7 which is obtained by dispersing activated carbon powder 2*b* and binder 2*c* in a solvent. As a result of passing through slurry pan 8, supporter 2*a* is impregnated with activated carbon powder 2*b* and binder 2*c*.

Thereafter, supporter 2*a* is pulled upwardly as shown in FIG. 3, and passes through gap 9*a* between two round bars 9 for producing a gap, whereby supporter 2*a* is formed with a desired thickness.

Both sides of supporter 2*a* formed with a desired thickness are exposed to hot air from hot air nozzle 10 so as to be dried, and then supporter 2*a* is rewound by rewinding portion 11.

By tailoring supporter 2*a* having been rewound by rewinding portion 11 into a desired shape, activated carbon sheet 2 shown in FIG. 2 is finally completed.

In this manner, activated carbon sheet 2 of the embodiment can be produced just by impregnating supporter 2*a* with slurry 7 using impregnation coating device 5, and it is possible to reduce performance difference between activated carbon sheets 2 as finished products. Accordingly, the productivity of activated carbon sheet 2 of the embodiment is excellent.

Herein, materials that are used as supporter 2*a*, activated carbon powder 2*b*, and binder 2*c* configuring activated carbon sheet 2 will be described. In addition, the configuration of slurry 7 for manufacturing activated carbon sheet 2 will be described as follows.

As supporter 2*a*, it is desirable to use materials having air permeability such as unwoven fabric, woven fabric, paper, a wire mesh, a punching metal, and a porous material. This is because using these materials having excellent air permeability makes it possible for activated carbon powder 2*b* to sufficiently contact air, whereby the bass reproduction function of speaker device 1 can be improved. The unwoven fabric and woven fabric not only have excellent air permeability but are light. Accordingly, supporter 2*a* using the unwoven fabric or woven fabric is excellent in terms of lightening speaker device 1.

As the unwoven fabric and woven fabric used for supporter 2*a*, for example, it is desirable to use one formed of one or more materials including rayon fiber, nylon fiber, polyester fiber, polypropylene fiber, acrylic fiber, vinylon fiber, aramid fiber, polylactic fiber, bamboo fiber, cotton fiber, wool fiber, linen fiber, pulp fiber, silk fiber, and glass fiber. Particularly, if the unwoven fabric is formed of bamboo fiber, since the bamboo fiber has an excellent strength, it is difficult to break activated carbon sheet 2 as a finished product. Moreover, the bamboo fiber has a deodorizing effect.

If activated carbon sheet 2 is manufactured using bamboo fiber or polylactic fiber obtained from a starch derived from plants, toxic substances are not generated when the sheet is discarded, so it is possible to manufacture activated carbon sheet 2 while considering an environmental aspect.

As the material of the wire mesh and punching metal, it is desirable to use, for example, copper, aluminum, iron, nickel, zinc, and an alloy thereof. The porosity of the wire mesh and punching metal is preferably 10% to 70%. If the porosity is less than 10%, the weight of activated carbon powder 2*b* that can impregnate the inside of supporter 2*a* that can be impregnated with liquid is reduced, so activated carbon sheet 2 including a small weight of activated carbon powder 2*b* is manufactured. Accordingly, a sufficient bass reproduction effect is not obtained. If the porosity is greater than 70%, since activated carbon sheet 2 includes an excessively large number of pores, the density of activated carbon powder 2*b* in activated carbon sheet 2 is reduced. Accordingly, a sufficient bass reproduction effect is not obtained. From the above points of view, it is desirable that the porosity of the punching metal is 10% to 70%.

When supporter 2*a* is thinner than 50 μm, if a large amount of activated carbon powder 2*b* is attached to supporter 2*a*, the strength of a coating film of activated carbon sheet 2 is weakened. From the above view points, the thickness of supporter 2*a* is preferably 50 μm or more, and sufficient strength is obtained if the thickness is 80 μm or more.

As a raw material of activated carbon powder 2*b*, it is preferable to use materials based on plants such as coconut husk, petroleum coke, pitch, or a phenol resin, but the material is not particularly limited. In order to heighten the effect of the activated carbon powder 2*b* as a pressure adjustor, it is preferable that the contact area with air is large. Therefore, materials having a large specific surface area are preferable. If the specific surface area of activated carbon powder 2*b* is smaller than 100 $m^2/g$, since the contact area between activated carbon powder 2*b* and air is small, a sufficient bass reproduction function is not obtained. If the specific surface area of the activated carbon is larger than 3500 $m^2/g$, the contact area between activated carbon powder 2*b* and air is enlarged, but the density of activated carbon powder 2*b* is reduced. Accordingly, the weight of activated carbon powder 2*b* included in activated carbon sheet 2 is reduced, so a sufficient bass reproduction function is not obtained. From the above view points, the specific surface area of activated carbon powder 2*b* is desirably 100 $m^2/g$ to 3500 $m^2/g$.

If the average particle diameter D50 of activated carbon powder 2*b* is smaller than 1 μm, unless the amount of binder 2*c* to be added is increased to increase the surface area of activated carbon powder 2*b*, activated carbon powder 2*b* cannot be dispersed in a proper state. On the other hand, if the amount of binder 2*c* to be added increases excessively, binder 2*c* covers the surface of activated carbon powder 2*b*, so the bass reproduction function of activated carbon sheet 2 deteriorates. From the above view points, average particle diameter D50 of activated carbon powder 2*b* is desirably 1 μm or more.

If the volume of pores having a radius of 1 nm or less in activated carbon powder 2*b* per unit weight is smaller than 0.6 ml/g, the volume adsorbing air molecules is reduced, so sufficient bass reproduction function is not obtained. Therefore, it is desirable that the pore having a radius of 1 nm or less, which is included in activated carbon powder 2*b*, have a cumulative pore volume of 0.6 ml/g.

As binder 2*c*, it is desirable to use one or more kinds of materials including an ammonium salt or sodium salt of carboxymethyl cellulose (CMC) which is a water-soluble aqueous binder; polyvinylpyrolidone; polyvinylalcohol; methylcellulose; a hydroxypropyl cellulose resin; an aqueous dispersion of polytetrafluoroethylene which is an aqueous binder dispersion; a latex; an emulsion of a urethane resin, an olefin-based resin, and an acrylic resin; or nonwood pulp and the like. The latex herein refers to a material in which a polymer substance is stably dispersed in an aqueous medium.

As the configuration of slurry 7, it is desirable that the solid content ratio including a combination of activated carbon powder 2*b* and binder 2*c* is 10% by weight to 40% by weight. If the solid content ratio is lower than 10% by weight, the thickness of activated carbon sheet 2 is reduced, so activated carbon powder 2*b* cannot be included in activated carbon sheet 2 in a sufficient weight. If the solid content ratio is higher than 40% by weight, it is difficult to disperse activated carbon powder 2*b* in a solvent, so proper slurry 7 is not obtained, and activated carbon sheet 2 demonstrating a sufficient performance cannot be obtained. From the above view points, the solid content ratio including a combination of activated carbon powder 2*b* and binder 2*c* in slurry 7 is desirably 10% by weight to 40% by weight.

As a solvent of slurry 7, water can be used. This is because if water is used, drying can be performed easily, and an environmental burden is reduced.

Next, the result of comparison and examination performed with respect to the content rate of supporter 2*a*, activated carbon powder 2*b*, and binder 2*c*, which configure activated carbon sheet 2 as a pressure adjustor, will be described in detail as follows.

Figure 4:
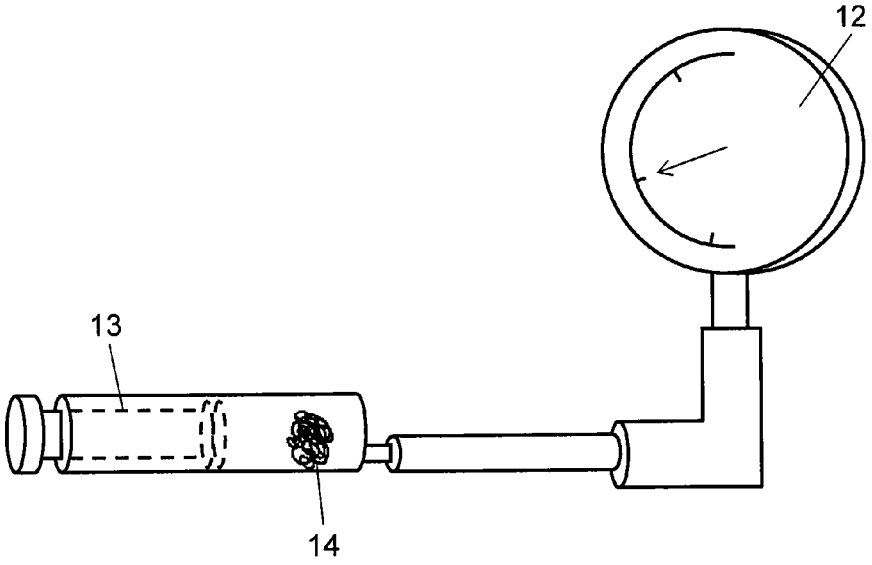
FIG. 4 is a view illustrating an evaluation device according to Embodiment 1 of the invention.

An evaluation device shown in FIG. 4 was used to perform the comparison and examination. FIG. 4 is a view illustrating an evaluation device according to Embodiment 1 of the invention. A part of this example and comparative examples will be described as follows. In FIG. 4, pressure was measured using bourdon tube pressure gauge 12. The internal volume of 30 cc glass tube syringe 13 can be changed by pressing a movable piston. Product to be tested 14 (activated carbon sheet 2) was used in the following Example 1-1, Example 1-2, and Comparative example 1.

EXAMPLE 1-1

The coconut husk was carbonized and then activated with vapor to produce powdered activated carbon powder 2*b*. 95% by weight of this activated carbon powder 2*b* having average particle diameter D50 of about 20 μm and the volume of pores having a radius of 1 nm or less per unit weight of 0.6 ml/g was mixed with 3% by weight of an ammonium salt of CMC which is an aqueous binder as binder 2*c* and 2% by weight of a latex of a styrene butadiene rubber which is an aqueous binder dispersion, thereby producing activated carbon sheet 2. Produced activated carbon sheet 2 containing 1 g of activated carbon powder 2*b* was introduced into a 30 cc glass tube syringe 13, and differential pressure generated when the volume of 30 cc glass tube syringe 13 was compressed to 5 cc from 30 cc was measured.

EXAMPLE 1-2

The coconut husk was carbonized and then activated with vapor to produce powdered activated carbon powder 2*b*. 76% by weight of this activated carbon powder 2*b* having average particle diameter D50 of about 20 μm and the volume of pores having a radius of 1 nm or less per unit weight of 0.6 ml/g was mixed with 12% by weight of an ammonium salt of CMC which is an aqueous binder as binder 2*c* and 12% by weight of a latex of a styrene butadiene rubber which is an aqueous binder dispersion, thereby producing activated carbon sheet 2. Produced activated carbon sheet 2 containing 1 g of activated carbon powder 2*b* was introduced into a 30 cc glass tube syringe 13, and differential pressure generated when the volume of 30 cc glass tube syringe 13 was compressed to 5 cc from 30 cc was measured.

EXAMPLE 1-3

The coconut husk was carbonized and then activated with vapor to produce powdered activated carbon powder 2*b*. 85% by weight of this activated carbon powder 2*b* having average particle diameter D50 of about 20 μm and the volume of pores having a radius of 1 nm or less per unit weight of 0.6 ml/g was mixed with 3% by weight of an ammonium salt of CMC which is an aqueous binder as binder 2*c* and 12% by weight of a latex of a styrene butadiene rubber which is an aqueous binder dispersion, thereby producing activated carbon sheet 2. Produced activated carbon sheet 2 containing 1 g of activated carbon powder 2*b* was introduced into a 30 cc glass tube syringe 13, and differential pressure generated when the volume of 30 cc glass tube syringe 13 was compressed to 5 cc from 30 cc was measured. The differential pressure was 0.145 Mpa.

COMPARATIVE EXAMPLE 1

Activated carbon sheet 2 was not introduced into 30 cc glass tube syringe 13, and the differential pressure generated when the volume of 30 cc glass tube syringe 13, which did not contain anything, was compressed to 5 cc from 30 cc was measured.

As a result of comparison performed under the above conditions, the differential pressure was 0.140 MPa in (Example 1-1), 0.160 MPa in (Example 1-2), and 0.195 MPa in (Comparative example 1).

First, from the result of (Example 1-1) and (Comparative example 1), it was found that by activated carbon sheet 2 according to the embodiment, the differential pressure was obviously reduced, and that the internal pressure change of 30 cc glass tube syringe 13 was suppressed. This result clearly shows that the bass reproduction function of a speaker box on which activated carbon sheet 2 according to the embodiment is mounted is improved.

Comparing the results of (Example 1-1) with (Example 1-2), it is found that (Example 1-1) can more reliably suppress the internal pressure change of 30 cc glass tube syringe 13.

It is considered that this is because the amount of binder 2*c* in (Example 1-1) is smaller than that of (Example 1-2). That is, if activated carbon sheet 2 contains an excessive amount of binder 2*c*, binder 2*c* covers the surface of activated carbon powder 2*b*, so activated carbon powder 2*b* cannot sufficiently adsorb the air in 30 cc glass tube syringe 13. As a result, as the ratio of activated carbon powder 2*b* and binder 2*c* in activated carbon sheet 2 according to the embodiment, the ratio of activated carbon powder 2*b* is desirably 75% by weight or more, a solvent-soluble binder as binder 2*c* is desirably 10% by weight or less, and a solvent-insoluble binder as binder 2*c* is desirably 15% by weight or less.

Next, a part of examples and examination results of characteristic thereof in Embodiment 1 will be described as follows, but the scope of the invention is not limited at all by the examples.

EXAMPLE 2-1

The coconut husk was carbonized and then activated with vapor to produce powdered activated carbon powder 2*b*. 95% by weight of this activated carbon powder 2*b* having average particle diameter D50 of about 20 μm and the volume of pores having a radius of 1 nm or less per unit weight of 0.6 ml/g was mixed with 3% by weight of an ammonium salt of CMC which is an aqueous binder as binder 2*c* and 2% by weight of a latex of a styrene butadiene rubber which is an aqueous binder dispersion, thereby producing a mixture. This mixture was added to water so as to yield a solid content ratio of 30%, followed by dispersing, thereby obtaining slurry 7. As supporter 2*a*, unwoven polyester fabric having a thickness of about 150 μm and weight (basis weight) per unit area of about 40 g/m$^2$ was used.

To impregnate the unwoven fabric with activated carbon powder 2*b*, a dipping type of impregnation coating device was used. By causing the unwoven fabric supplied from unwinding portion 6 to pass through slurry 7 in slurry pan 8, the inside and surface of the unwoven fabric was impregnated with slurry 7. Thereafter, by causing the fabric to pass through 500 μm of gap 9*a* formed by round bars 9 for producing a gap, the amount of slurry 7 impregnating the inside and the surface of the unwoven fabric was adjusted. The unwoven fabric impregnated with slurry 7 was dried with 100° C. of hot air and rewound by rewinding portion 11, thereby obtaining supporter 2*a* having a thickness of about 600 μm, including about 160 g/m$^2$ of activated carbon powder 2*b* per unit area, and having a basis weight of about 200 g/m$^2$.

Supporter 2*a* having undergone the above steps was tailored into 45 mm×105 mm, thereby obtaining activated carbon sheet 2.

EXAMPLE 2-2

Supporter 2*a* impregnated with slurry 7, which was obtained from the above steps in (Example 2-1) was pressed with 20 MPa, thereby obtaining supporter 2*a* having a thickness of about 450 μm, including about 160 g/m$^2$ of activated carbon powder 2*b* per unit area, and having a basis weight of about 200 g/m$^2$.

Obtained supporter 2*a* was tailored into 45 mm×105 mm, thereby obtaining activated carbon sheet 2.

EXAMPLE 2-3

About 10 holes/c m$^2$ were opened in activated carbon sheet 2 of (Example 2-2) using a needle.

EXAMPLE 2-4

The phenol resin was carbonized and then activated with potassium hydroxide (KOH) which is an alkali to produce powdered activated carbon powder 2*b*. 93% by weight of this activated carbon powder 2*b* having average particle diameter D50 of about 3 μm and the volume of pores having a radius of 1 nm or less per unit weight of 0.9 ml/g was mixed with 5% by weight of an ammonium salt of CMC which is an aqueous binder as binder 2*c* and 2% by weight of a latex of a styrene butadiene rubber which is an aqueous binder dispersion, thereby producing a mixture. This mixture was added to water so as to yield a solid content ratio of 30%, followed by dispersing, thereby obtaining slurry 7. Supporter 2*a* having a thickness of about 500 μm, including about 90 g/m$^2$ of activated carbon powder 2*b* per unit area, and having a basis weight of about 130 g/m$^2$ was obtained in the same manufacturing method as in Example 1, except that this slurry 7 was used.

Obtained supporter 2*a* was tailored into 45 mm×105 mm, thereby obtaining activated carbon sheet 2.

COMPARATIVE EXAMPLE 2

The coconut husk was carbonized and then activated with vapor to produce powdered activated carbon powder 2*b*. This activated carbon powder 2*b* having average particle diameter of about 350 μm and the volume of pores having a radius of 1 nm or less per unit weight of 0.1 ml/g was introduced into a 45 mm×105 mm bag formed of natural fiber, thereby obtaining a pressure adjustor.

Each of the activated carbon sheet 2 and the pressure adjustor in (Comparative example 2) was disposed inside cabinet 3, and the frequency characteristic (fO) was measured. The time taken for transmitting 200 cc of air under a pressure of 1.5 kPa in a case where the thickness of activated carbon sheet 2 is 1 cm is shown in the following table together with the result of frequency characteristic (fO) measurement.

TABLE 1

| Sample | fO measured in the absence of pressure adjustor (Hz) | fO measured in the presence of pressure adjustor (Hz) | Weight of pressure adjustor (activated carbon) (g) | Volume of pressure adjustor ($cm^3$) | Basis weight ($g/m^2$) | Thickness of activated carbon sheet (μm) | Transmission time of 200 cc of air per 1 cm of thickness of activated carbon sheet. (s/cm) |
|---|---|---|---|---|---|---|---|
| Example 2-1 | 89.1 | 85.4 (−3.7 Hz) | 10 | 25.6 | 227 | 582 | 10.3 |
| Example 2-2 | 89.1 | 87.9 (−1.2 Hz) | 10 | 21.5 | 214 | 439 | 140 |
| Example 2-3 | 89.1 | 85.4 (−3.7 Hz) | 10 | 21.5 | 208 | 447 | 25.3 |
| Example 2-4 | 89.1 | 85.1 (−4.0 Hz) | 10 | 30 | 125 | 462 | 21.9 |
| Comparative example 2 | 89.1 | 87.8 (−1.3 Hz) | 10 | 76.8 | — | — | — |

The "pressure adjustor" in Table 1 refers to activated carbon sheet 2 in (Example 2-1), (Example 2-2), (Example 2-3), and (Example 2-4), and refers to particle-like activated carbon powder 2*b* in (Comparative example 2).

The following description can be made from the above results.

First, it was found that fO had been drastically reduced in (Example 2-1), (Example 2-3), and (Example 2-4), compared to (Comparative example 2). Moreover, the volume of the pressure adjustor in (Comparative example 2) was very large. Accordingly, by disposing activated carbon sheet 2 of the embodiment in speaker device 1, bass reproduction function that is equivalent to or better than that of the conventional one can be obtained even if the pressure adjustor is smaller than the conventional one.

On the other hand, in (Example 2-2), the reduction in fO was not found to be as marked as in other examples.

This is because activated carbon sheet 2 was pressed in (Example 2-2). That is, since activated carbon sheet 2 was pressed, the air permeability of activated carbon sheet 2 was reduced as shown in (Table 1). In other words, since the air did not reach activated carbon powder 2*b* inside activated carbon sheet 2, the air adsorbing function of activated carbon sheet 2 deteriorated. As a result, the bass reproduction function deteriorated. For this reason, as shown in (Table 1), it is desirable that the time taken for 200 cc of air to be transmitted under a pressure of 1.5 kPa is 30 seconds or less per 1 cm of thickness of activated carbon sheet 2.

Here, as shown in (Example 2-3), it was found that, if holes are opened in activated carbon sheet 2 of (Example 2-2) using a needle, the air permeability is improved as shown in Table 1, and a sufficient bass reproduction function is obtained. Consequently, after activated carbon sheet 2 is pressed, if holes are opened on activated carbon sheet 2 using a needle, or activated carbon sheet 2 is unstiffened, a sufficient bass reproduction function can be secured, and activated carbon sheet 2 can be made even thinner.

Figure 5:
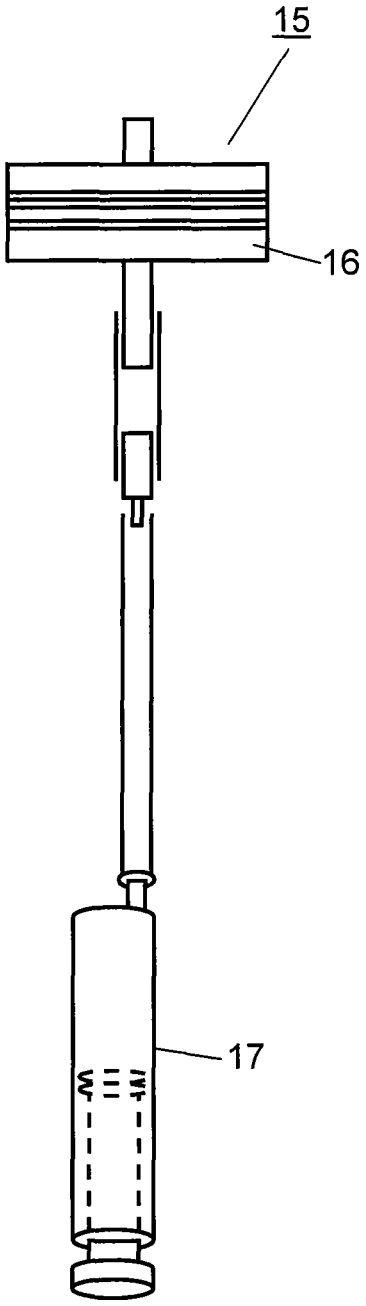
FIG. 5 is a view illustrating an air permeability-measuring device according to Embodiment 1 of the invention.

FIG. 5 is a view illustrating an air permeability-measuring device used in Embodiment 1 of the invention. In Table 1, the transmission time of 200 cc of air per 1 cm of the thickness of activated carbon sheet 2 was measured using air permeability-measuring device 15 shown in FIG. 5. In air permeability-measuring device 15, activated carbon sheet 2 was fixed to sheet fixing portion 16, and the time taken for 225 g of piston 17 to fall 14 cm was measured, whereby the air permeability of activated carbon sheet 2 was measured. A note will be made herein that, in this air permeability measurement method, air is in a state which is equivalent to a state where the air is pressed under a pressure of 1.5 kPa, based on the relationship between the weight and sectional area of piston 17. In addition, the volume of air which is transmitted through activated carbon sheet 2 while piston 7 falls about 14 cm is 200 cc.

In air permeability-measuring device 15, the shorter the time taken for piston 17 to fall, the better the air permeability of activated carbon sheet 2.

The basis weight of supporter 2*a* is desirably 10 $g/m^2$ to 300 $g/m^2$, when woven fabric, unwoven fabric, paper or the like is used as supporter 2*a* that can be impregnated with liquid. If the basis weight of supporter 2*a* is smaller than 10 $g/m^2$, the strength of supporter 2*a* is weakened, and supporter 2*a* that can be impregnated with liquid is stretched or broken while being impregnated with slurry 7, so activated carbon sheet 2 is not obtained. If the basis weight of supporter 2*a* is larger than 300 $g/m^2$, the proportion of activated carbon powder 2*b* included per unit weight of activated carbon sheet 2 is reduced, so the weight of activated carbon sheet 2 necessary for obtaining the sufficient bass reproduction effect increases.

It is desirable that the thickness of activated carbon sheet 2 is 1 to 5 times larger than that of supporter 2*a* that can be impregnated with liquid. If the thickness of activated carbon sheet 2 is less than that of supporter 2*a* that can be impregnated with liquid, the proportion of supporter 2*a* in activated carbon sheet 2 increases. As a result, the weight of activated carbon powder 2*b* included in activated carbon sheet 2 is reduced, so the weight of activated carbon sheet 2 necessary for obtaining sufficient bass reproduction function increases. If the thickness of activated carbon sheet 2 is larger than 5 times of the thickness of supporter 2*a* that can be impregnated with liquid, air cannot reach activated carbon powder 2*b* inside activated carbon sheet 2, so the air adsorbing function and bass reproduction function of activated carbon sheet 2 deteriorate. Accordingly, it is desirable that the thickness of activated carbon sheet 2 is 1 to 5 times larger than that of supporter 2*a* that can be impregnated with liquid.

As described above, since the pressure adjustor can be made thin, activated carbon sheet 2 of the embodiment can perform bass reproduction while saving space. If activated carbon sheet 2 is configured by giving attention to the above points, a better effect could be obtained.

In practical use, it is desirable to stack a plurality of sheets of activated carbon sheet 2 for use. By stacking a plurality of sheets of activated carbon sheet 2, the amount of air to be adsorbed onto activated carbon powder 2*b* increases so that the air between activated carbon sheets 2 can also be effectively used. Consequently, since the weight of activated carbon powder 2*b* that can be introduced into cabinet 3 increases, the bass reproduction function is improved.

Activated carbon sheet 2 may have a sandwich structure coated with natural fiber. Coating with the natural fiber makes it possible to prevent short-circuit of an electronic device which occurs when activated carbon powder 2*b* having conductivity comes off the sheet. Moreover, since the natural fiber transmits air, even if activated carbon sheet 2 is coated with the fiber, the air adsorbing function can be maintained to some degree. Therefore, the bass reproduction function hardly deteriorates.

It is desirable that cabinet 3 of speaker device 1 is kept sealed. If cabinet 3 is an open type, vapor is adsorbed onto pores of activated carbon powder 2*b* due to the influence of humidity depending on the usage environment and season. Consequently, the air-adsorbing function of activated carbon powder 2*b* deteriorates, and the bass reproduction function also deteriorates. Accordingly, it is preferable to use a structure in which moisture is prevented from entering by sealing.

Embodiment 2

Figure 6:
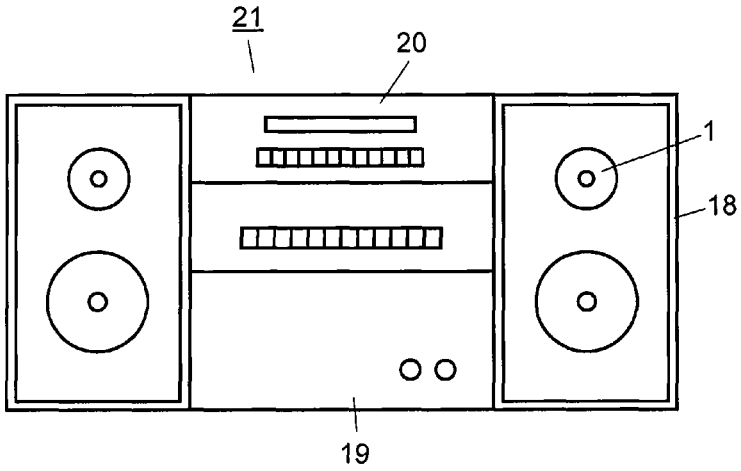
FIG. 6 is an exterior view of an electronic device according to Embodiment 2 of the invention.

FIG. 6 is an exterior view of an electronic device according to Embodiment 2 of the invention.

In the respective present embodiment, a mini component system for audio, which is an electronic device, is configured by mounting speaker device 1 of the Embodiment 1.

As shown in FIG. 6, speaker device 1 of the invention is installed in enclosure 18 so as to configure a speaker system. Mini component system 21 for audio is configured with amplifier 19 that is an amplifier of electric signals to be input in speaker device 1 and player 20 outputting a source to amplifier 19.

With this configuration, it is possible to realize the improvement of the durability and reliability of the electronic device and to realize digital responsiveness, high input resistance, and deep-bass reproduction even with a small and compact speaker.

In the present embodiment, an example is described in which the speaker device is mounted on a mini component system for audio which is an electronic device. However, the invention is not limited thereto. That is, the electronic device may be video equipment such as a television or the like or mobile communication equipment. In other words, any electronic device can be used so long as the electronic device is equipped with a speaker.

EXAMPLE 3

Figure 7:
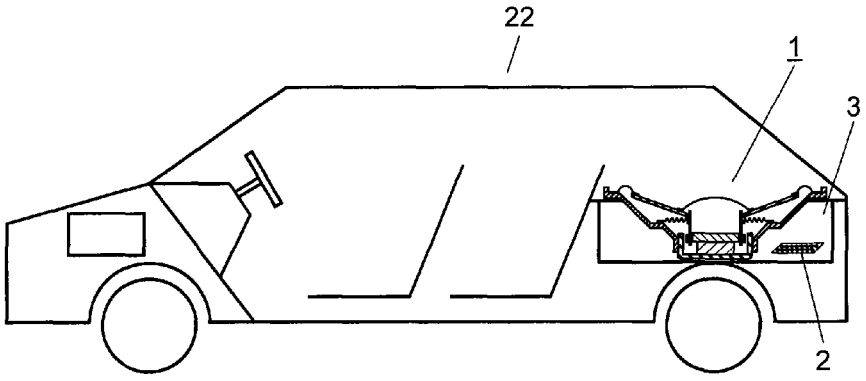
FIG. 7 is a schematic view of a vehicle according to Embodiment 3 of the invention.
Figure 8:
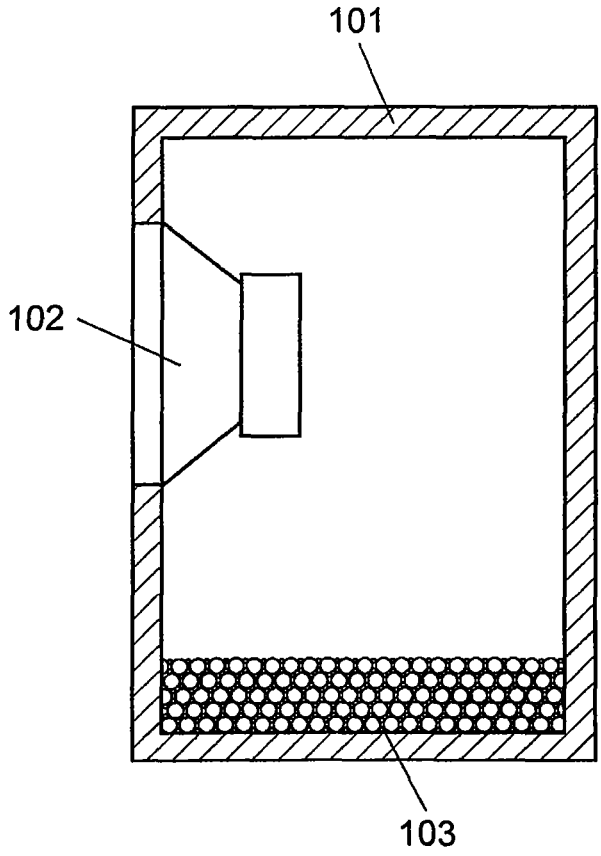
FIG. 8 PRIOR ART
FIG. 8 is a view illustrating a conventional speaker device.

FIG. 7 is a cross-sectional view of a vehicle illustrating the device of Embodiment 3 of the invention.

In the respective present embodiment, a vehicle is configured which is an apparatus on which speaker device 1 is mounted.

That is, the embodiment is a configuration in which speaker device 1 is mounted on a rear tray of vehicle 22.

Use of speaker device 1 of the invention offers a feature that vibration sound of the powder of the pressure adjustor (activated carbon) is not caused as in the conventional case even when the vehicle is driven.

Consequently, it is possible to lighten vehicle 22 as an apparatus and to realize digital responsiveness, high input resistance, and deep-base reproduction function even with a small and compact speaker.

In the embodiment, an example of mounting a speaker device on vehicle 22 as an apparatus is described. However, the invention is not limited thereto, and moving apparatuses such as trains or ships and a structure such as a house may be used. That is, any apparatus can be used as long as a speaker is mounted on the apparatus.

INDUSTRIAL APPLICABILITY

If the activated carbon sheet according to the invention is used as a pressure adjustor, it is possible to make a speaker device small, and to improve the bass reproduction function. The speaker device using the invention is suitably used for video and audio equipment, information communication equipment, a game machine or the like for which miniaturization, compactification, digital responsiveness, high input resistance, and deep-bass reproduction are required.

The invention claimed is:

1. A pressure adjustor comprising:

a sheet-like supporter made of unwoven fabric or woven fabric;

a plurality of activated carbon powder particles impregnating an inside of the supporter; and binders binding the plurality of activated carbon powder particles to each other, wherein the plurality of activated carbon powder particles has pores having a radius of 1 nm or less, and wherein the volume of the pores in the activated carbon powder particles per unit weight of the activated carbon powder particles is 0.6 ml/g or more.

2. The pressure adjustor of claim 1, wherein the weight ratio of the activated carbon powder and the binders is 75% by weight or more for the activated carbon powder, and 10% by weight or less for a solvent-soluble fraction and 15% by weight or less for a solvent-insoluble fraction among the binders.

3. The pressure adjustor of claim 1, wherein time taken for air to be transmitted through the pressure adjustor is 30 seconds or less for 200 cc of air per 1 cm of the thickness of the sheet-like pressure adjustor under a pressure of 1.5 kPa.

4. A speaker device using the pressure adjustor of claim 1 comprising:

a cabinet; and a speaker unit provided in the cabinet, wherein the pressure adjustor is disposed inside the cabinet.

5. The pressure adjustor of claim 1, wherein the sheet-like supporter can be impregnated with liquid.

6. The pressure adjustor of claim 1, wherein the sheet-like supporter is made of a material different from carbon.

7. A method of manufacturing a pressure adjustor, comprising:

preparing a slurry containing solvent, activated carbon powder, and binders; and impregnating a sheet-like supporter made of unwoven fabric or woven fabric with the slurry, wherein in the preparing of the slurry from the solvent, the activated carbon powder, and the binders, the weight ratio of the activated carbon powder and the binders in the slurry is 75% by weight or more for the activated carbon powder, and 10% by weight or less for the solvent-soluble fraction and 15% by weight or less for the solvent-insoluble fraction among the binders.

8. An electronic device on which the speaker device of claim 4 has been mounted.

9. A vehicle on which the speaker device of claim 4 has been mounted.

10. The method of claim 7, further comprising drying the sheet-like supporter after impregnating the sheet-like supporter with the slurry, wherein the activated carbon powder impregnates an inside of the sheet-like supporter, and the binders bind particles of the activated carbon powder.

11. The method of claim 7, wherein the sheet-like supporter is made of a material different than carbon.

* * * * *